US005092027A

United States Patent [19]

Denner

[11] Patent Number: 5,092,027

[45] Date of Patent: Mar. 3, 1992

[54] METHOD FOR RETAINING AND PROTECTING A TRANSFORMER CORE

[75] Inventor: Harry T. Denner, Zanesville, Ohio

[73] Assignee: Cooper Industries, Inc., Houston, Tex.

[21] Appl. No.: 766,616

[22] Filed: Sep. 26, 1991

Related U.S. Application Data

[60] Division of Ser. No. 610,183, Nov. 7, 1990, Pat. No. 5,073,765, which is a continuation of Ser. No. 349,733, May 9, 1989, abandoned.

[51] Int. Cl.[5] ..... H01F 41/02; H01F 27/26

[52] U.S. Cl. ..... 29/607; 336/210

[58] Field of Search ..... 24/20 R, 20 EE, 20 W, 24/17 R, 17 B; 29/607, 602.1, 605; 310/217, 218

[56] References Cited

U.S. PATENT DOCUMENTS

| | | | |
|---|---|---|---|
| 2,023,059 | 12/1935 | Vaughan | 24/20 EE |
| 3,082,390 | 3/1963 | Peterson | 336/210 |
| 3,262,077 | 7/1966 | Wroblewski | 336/210 X |
| 3,295,084 | 12/1966 | Horstman | 336/210 X |
| 3,792,399 | 2/1974 | McLyman | 336/210 |
| 4,707,678 | 11/1987 | Siman | 336/210 |
| 4,789,849 | 12/1988 | Ballard et al. | 336/210 |

FOREIGN PATENT DOCUMENTS

| | | | |
|---|---|---|---|
| 2413889 | 10/1975 | Fed. Rep. of Germany | 24/20 R |
| 2413890 | 10/1975 | Fed. Rep. of Germany | 24/20 R |
| 9722 | 10/1932 | United Kingdom | 24/20 W |

*Primary Examiner*—Thomas J. Kozma
*Attorney, Agent, or Firm*—David A. Rose

[57] ABSTRACT

Disclosed is a retaining band for the magnetic core loop of an electrical transformer. The retaining band includes a locking mechanism to hold it in place around the core. The locking is accomplished by overlapping the ends of the band, cutting a pair of incisions in the overlapping region which extend from the sides of the band inwardly, and then bending the resulting tab(s) inwardly. If desired, the tabs can be spot welded to provide added locking force.

2 Claims, 1 Drawing Sheet

METHOD FOR RETAINING AND PROTECTING A TRANSFORMER CORE

This is a continuation of copending application Ser. No. 07,610,183, now U.S. Pat. No. 5,073,765 filed on 11/7/90 which is a continuation of Ser. No. 07,349,733 filed 5/9/89 now abandoned.

FIELD OF THE INVENTION

The invention relates to a retaining band for a magnetic core which is made up of multiple laminated thin strips.

BACKGROUND OF THE INVENTION

The magnetic core of an electrical transformer can be formed of a number of laminated thin strips of a material which can be readily magnetized. The core material, for example, can be silicon steel or Metglas (T TM). To make the core, the magnetic strips are formed into a loop. This loop is in the form of a circular shape, and, if desired, thereafter it is formed into a rectangular shape. The joints of each lamination in the core are positioned in a prescribed attitude to enhance the magnetic qualities of the loop. After formation the core is annealed. It can then be assembled with a coil as a final step.

Metglas (TM) is an amorphous, crystalline material which is very brittle Thus, the laminations in such a core need protection. If they are not properly protected and they are bumped, dropped or otherwise improperly contacted, they can shatter or deform. In either case, the transformer may not function properly as a result of the contact.

Thus, there is a need to retain the core laminations, and to surround and protect the laminations from bumping, dropping, or other contact. This can be accomplished with a retainer which protects the core through formation, annealing, and also after the core is assemble with a coil.

Several methods of retaining metallic transformer cores have been suggested in the prior art. In U.S. Pat. No. 4,673,907, a band which is tightened and then clipped at its free ends to hold it in place is used to hold clamping plates and insulating plates in place, which in turn retain a metallic core. U.S. Pat. No. 4,723,349 discloses interlocking joints 116, 118 which hold two U-shaped members in place, and which in turn retain a metallic core. Each interlocking joint uses a tongue-in-slot arrangement. U.S. Pat. No. 4,364,020 discloses a protective outer layer for a core assembly made of s steel to protect the core. In U.S. Pat. No. 4,663,605, flexible banding under tension clamps two plates spaced outwardly from two yokes, and the clamping forces are transmitted to the coil structures by paths which bypass a rectangular core. The band is preferably held in place by a clip 68.

A retaining system which is simple, inexpensive, and easy to use is described below.

SUMMARY OF THE INVENTION

The present invention includes a band for surrounding and protecting a magnetic core and a system to retain the band in place. The band is preferably made of a ductile iron-based material, such as mild steel, and is particularly useful for protection if the core is made of Metglas (TM). This material is brittle in nature.

The band is bent around the magnetic core, which may be of either circular, rectangular, or other shape, and the ends of the band are overlapped. At least one pair of substantially parallel incisions extend from one edge of the band ends in the overlapping region and towards the center of the band. The incisions sever both pieces of material and form a tab therebetween. The tab can be bent over towards the center of the band to lock the band in place, and, if desired, it can be welded in the bent position for added locking effect.

A preferred embodiment of the band of the invention has two tabs on opposite edge of the overlapping region. However, the band can also include a greater or lesser number of tabs.

The invention will now be described in greater detail with reference to the drawings.

DESCRIPTION OF THE PREFERRED EMBODIMENT

Figure 1:
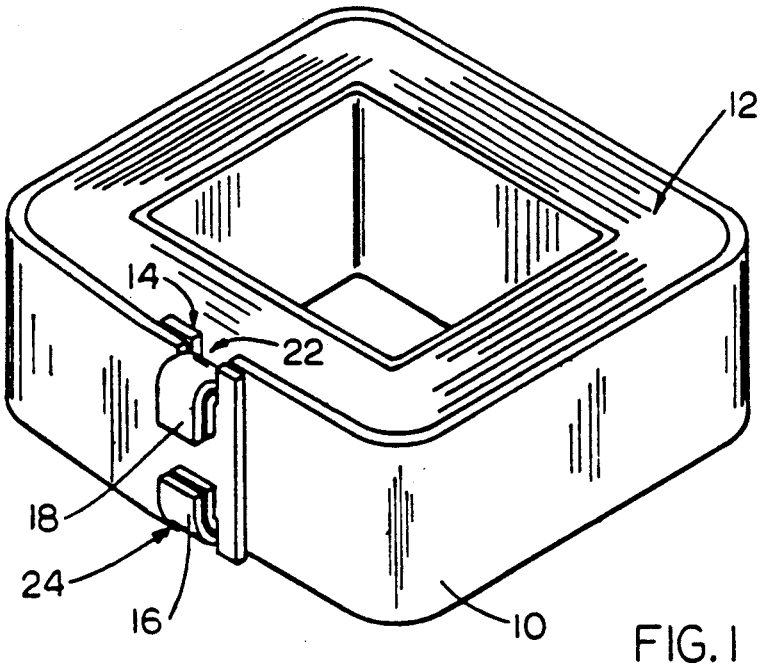
FIG. 1 is a perspective view of a magnetic core loop surrounded by a band and showing two oppositely facing tabs in locking position.

Referring to FIG. 1, a band 10 is shown surrounding and protecting a substantially rectangular magnetic core loop 12 which, in this embodiment, is made of Metglas (TM). The ends of band 10 overlap to form a region of overlap 14. Region 14 has two tabs 16 and 18, one being formed in each edge of the overlapping band ends, and each being bent towards the center of band 10, thereby locking band 10 in the retaining position.

Band 10 is preferably made of a ductile iron based material, for example mild steel. Other ductile materials, such as stainless steel, silicon steel or bronze, may also be used. It is preferably no more than 28 gauge (0.0149 inch) in thickness, in order to facilitate bending it around core loop 12. The width of band 10 is preferably at least that of the core laminations. A band 10 of such dimensions adequately covers and protects the thin laminated strips of core 12.

Band 10 is preferably long enough to surround core 12 completely and provide sufficient overlap in region 14 to allow formation of the tabs. 1½ inches of overlap is generally adequate to form two oppositely facing tabs 16 and 18 on a rectangular core with sides of a length of 5 inches to 24 inches or more. However, a larger overlapping region 14 may be desired if, for example, more tabs in the region are desired or needed, as described below.

The tabs are formed by cutting through band 10 at region of overlap 14. To form each tab, two substantially parallel cuts are made transversely to the edges of band 10. They can be made, for example, with needle nosed snips inserted between magnetic core 12 and band 10. The amorphous nature of the Metglas core allows the strips to bend to accommodate the snips in this fashion. The cuts have a depth and are spaced so as to produce a tab which can be bent over on the overlapping end of the band and will have sufficient strength to secure the band around the coil. For example, for a band on a square coil with sides of length from 5 inches to 24 inches which is 2 inches to twelve inches wide, the cuts may be about one-half inch apart and extend about one-half inch towards the center of band 10.

Tabs 16 and 18 lock band 10 into place around core 12 when their respective edges which are nearest the side of band 10 are bent over towards the center of band 10 and into locking position, as shown in FIG. 1. It can be seen that in this position, the edges of tabs 16 and 18 rest within slots 22 and 24, the slots being formed by the bending operation. Band 10 is thus locked into place and its perimeter dimension cannot expand.

In the locking position band 10 is secured around the thin, easily damaged laminations of core loop 12, and it helps prevent damage to these laminations. Band 10 also prevents core loop 12 from expanding out of the substantially rectangular shape shown.

Figure 2:
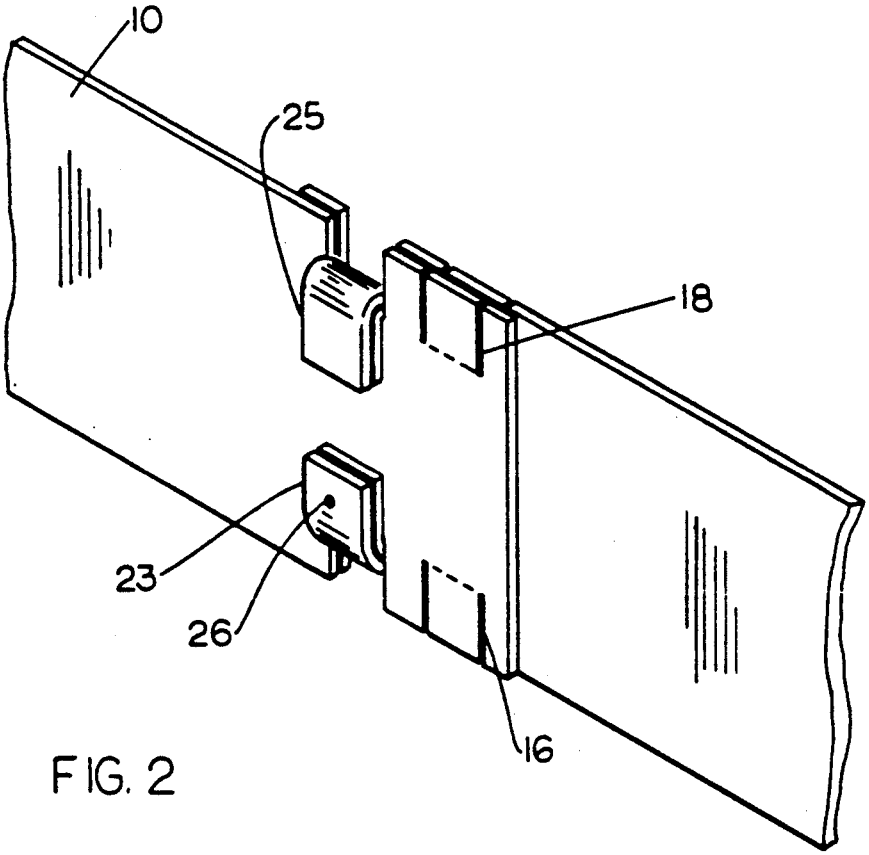
FIG. 2 is a perspective view of another embodiment of the invention in which the overlapping region has four tabs but with two of the four holding the band in position.

Rather than having two oppositely facing tabs 16 and 18, two or more additional tabs (e.g., tabs 23 and 25 in FIG. 2) can be provided in overlap region 14. These additional tabs may be desired if repeated bending of tabs 16 and 18 weaken them. Repeated bending and unbending can take place during formation of core loop 12, as described below. Also, additional tabs may be desired if after annealing and assembling the core and coil, the core does not assemble as tightly as it did prior to annealing and the original tabs do not align accurately. This misalignment is shown for tabs 16 and 18 in FIG. 2.

Additional tabs may also be provided if additional locking force for band 10 is needed or desired. However, one could also use tabs which are wider to increase the locking force.

In forming core loop 12, the laminated strips are first placed in the desired position For example, the strips of the FIG. 1 embodiment would be placed in a substantially round or rectangular shape. To retain them in this position, band 10, which is slightly longer than the periphery of core loop 12, is bent around the laminated strips, and the ends form overlap region 14, which can include tabs 16, 18, or additional tabs 23 and 25, as described above. Overlap region 14 can be adjusted so as to reside at any position on the perimeter of core 12, as needed for transformer design.

To retain band 10 in place, the tabs need not be fully bent and crimped against band 10. They can be partially bent, for example, to a position perpendicular to the surface of band 10, and still retain band 10 adequately. The only requirement is that they be bent enough to prevent the overlap region 14 from separating under the expanding force exerted by the elasticity of band 10.

It is necessary to anneal the laminated strips of core 12 to attain a properly functioning transformer. Band 10, with the tabs partially bent as described above, can retain the laminated strips during the annealing process. Thus, annealing is preferably carried out with the tabs in this partially bent position.

Following annealing, the tabs can be opened, and band 10 removed to allow core loop 12 to be assembled to the coils of a transformer. Such is the final step in forming a transformer.

Following assembly to a coil, band 10 is bent around the laminated strips of core 12 to the point where the tabs match each other. The tabs can be fully bent over to lock band 10 in place or, if they are misaligned or worn from multiple bending, new or additional tabs can be cut and then bent. The new tabs may also provide added retaining strength.

The tabs can be locked into place by crimping them tight against the side of band 10. The tabs can also be locked by spot Welding them in the approximate middle of the tab, as shown for spot 26 on tab 23 in FIG. 2. Welding bonds the two pieces of material forming the tab and aids in locking. Welding by a Tig or resistance method is preferred, as it is cleaner than regular arc welding.

The final assembled core-coil product has the fragile laminated strips held in place and protected by band 10. The product can be shipped with reduced fear of damage. Some advantages of using the retaining band of the invention include the fact that the mild steel band material is low cost, and it can be easily cut to the desired length. The ease with which it can be cut also aids in forming the tabs. It is noted that other materials, for example silicon steel, can be used for band 10. However, silicon steel is more difficult to weld than mild steel and is not preferred for this reason.

It should be understood that the embodiments described above are exemplary only and that many variations are possible and fall within the scope of protection, and further that the scope of protection is described only in the claims which follow and includes all equivalents of the subject matter of the claims.

What is claimed is:

1. A method for retaining and protecting a magnetic core loop, comprising the steps of:

providing a magnetic core having multiple laminated magnetized strips of a material which can be magnetized;

forming a loop of overlapping layers;

completely surrounding the magnetic core loop with a band having a length to form a region of overlap;

completely covering the periphery of the magnetic core loop with the band;

cutting through the band at the region of overlap to form a first connection with at least two opposing facing tabs;

bending the opposed tabs over onto the region of overlap to extend the band a first circumferential distance around the magnetic core loop;

resting the edges of the tabs within slots formed by the bending step;

locking the band in place around the magnetic core loop;

annealing the laminated strips of the magnetic core loop;

opening the first connection;

removing the bank;

assembling the magnetic core loop in a transformer;

again completely surrounding and covering the magnetic core loop with the band;

cutting through the band at a new location in the region of overlap to form a second connection with at least two new opposing facing tabs;

bending the new opposed tabs over onto the region of overlap to extend the band a second circumferential distance around the magnetic core loop;

resting the edges of the new opposed tabs within the new slots formed by the bending step; and locking the band in place around the magnetic core loop.

2. The method of claim 1 further including the step of welding the pieces of metal forming the new approved tabs.

* * * * *

UNITED STATES PATENT AND TRADEMARK OFFICE

CERTIFICATE OF CORRECTION

PATENT NO. : 5,092,027

DATED : March 3, 1992

INVENTOR(S) : HARRY T. DENNER

It is certified that error appears in the above—identified patent and that said Letters Patent is hereby corrected as shown below:

Column 1, line 2 : Delete "07,610,183" and insert --07/610,183--.

line 3 : Delete "07,349,733" and insert --07/349,733--.

line 19: Delete "Metglas (Ttm)" and insert --Metglass (TM)--.

line 38: Delete "assemble" and insert --assembled--.

line 50: Delete "s" and insert --silicon--.

Column 4, line 3 : Delete "Welding" and insert --welding--.

Signed and Sealed this

Sixth Day of July, 1993

Michael K. Kirk

*Attest:*

MICHAEL K. KIRK

*Attesting Officer*

*Acting Commissioner of Patents and Trademarks*